United States Patent [19]

Dighe et al.

[11] Patent Number: 4,769,065

[45] Date of Patent: Sep. 6, 1988

[54] CONTROL OF A PLASMA FIRED CUPOLA

[75] Inventors: Shyam V. Dighe, North Huntingdon; Paul E. Martin, West Mifflin, both of Pa.

[73] Assignee: Electric Power Research Institute, Palo Alto, Calif.

[21] Appl. No.: 47,810

[22] Filed: May 8, 1987

[51] Int. Cl.[4] ..... C22B 4/00; C21C 5/52

[52] U.S. Cl. ..... 75/10.12; 75/10.22

[58] Field of Search ..... 75/10.12, 10.22

[56] References Cited

U.S. PATENT DOCUMENTS 3,524,006 8/1970 Ebeling ..... 75/10.12

4,707,183 11/1987 Michard ..... 75/10.22

*Primary Examiner*—Peter D. Rosenberg

*Attorney, Agent, or Firm*—F. J. Baehr, Jr.

[57] ABSTRACT

A safe and effected method of starting up operating and shutting down a plasma fired cupola. The starting up and shutting down procedures incorporated interlocks and warning signals that insure the safety of the operators and equipment and the controls utilize the temperature of the iron in the spout as a focal point to control the torch output by separately changing field current, arc current, and torch air supply, to compensate for changes in charge make-up, particulate feed, percentage of shroud air to shroud recirculating gases to produce different irons at various melt rates.

12 Claims, 2 Drawing Sheets

CONTROL OF A PLASMA FIRED CUPOLA

BACKGROUND OF THE INVENTION

This invention relates to a method for controlling a cupola which receives a portion of its heat energy from a plasma torch.

The cupola is a vertical cylindrical shaped furnace in which alternate layers of coke, metal scrap, and fluxing material such as lime stone are placed. The coke is burned and the heat thereby produced is combined with heat input of the plasma torch to melt the scrap to form iron.

U.S. Pat. No. 4,530,101 describes a plasma fired cupola in which plasma torches are utilized to melt metal turnings in nozzles connected to the lower portion of the cupola.

A related application entitled Plasma Fired Feed Nozzle filed May 8, 1985 and assigned Ser. No. 047-811 describes how a plasma torch and feed nozzle are attached to the cupola and may be utilized to feed particulate material to the lower portion of the cupola.

Another related application entitled A Plasma Fired Cupola filed May 8, 1987 and assigned Ser. No. 047809 describes the operation of a cupola in which turnings and fine metal chips make up approximately 75% of the metal charge.

An application entitled Replacement Of Coke In A Plasma Fired Cupola filed May 8, 1987 and assigned Ser. No. 047-808 describe the operation of a cupola in which coke is replaced with bituminous or authracite coal or utilizes pulverized coal to provide up to 25% of the carbon required to melt metal turnings and fine chips to form iron. In a cupola with a plasma torch and plasma torch feed nozzle, the melt rate chemistry and temperature of the iron produced are affected by the charge make-up, particulate feed through the feed nozzle, the blast air or recirculated gases and the output of the plasma torch which is effected by the field current, arc current and air supplied to the plasma torch.

The object of this invention is to provide a reliable control system which allows a very wide range of operating conditions for producing a wide range of iron chemistry utilizing fine borings and chips as a major portion of the scrap being melted.

SUMMARY OF THE INVENTION

In general, a control system for a plasma fired cupola having a plasma torch disposed in a feed nozzle with an air supply, arc current supply and field current supply cooperating to raise and lower the heat output of the plasma torch, when utilized to make iron from scrap metal, wherein the iron is removed from the cupola via a spout disposed in the lower portion of the cupola comprises measuring the temperature of the molten iron in the spout and comparing the measured temperature of the molten iron with a predetermined temperature, selecting a desired melt rate and determining the plasma torch heat output required to produce this desired melt rate. To provide the desired heat output of the torch, ranges of air flow, arc current and field current are selected and within the selected ranges, arc current, air flow and field current supplied to the torch are individually changed until the measured temperature equals the predetermined temperature.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENTS

Figure 1:
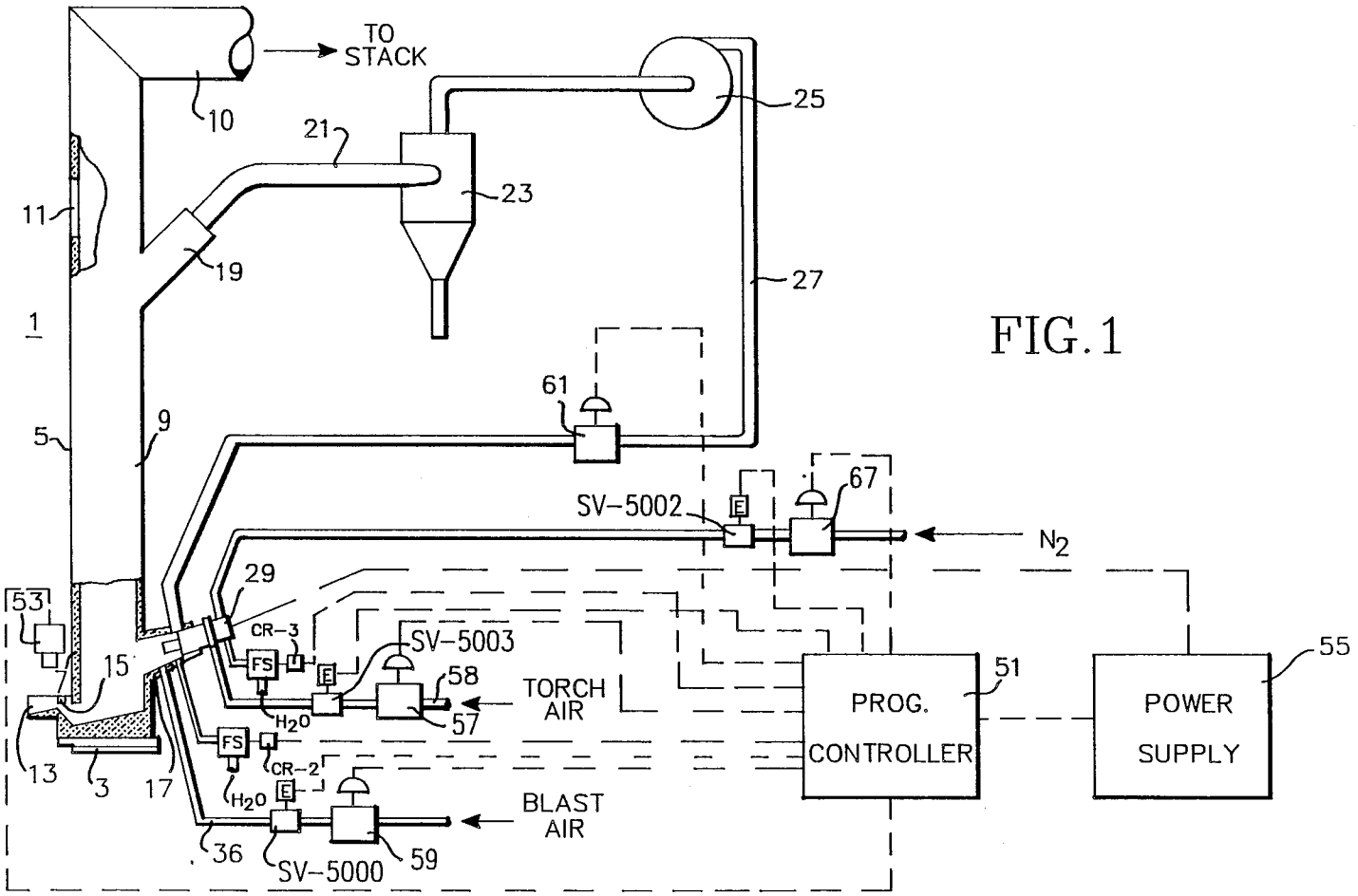
FIG. 1 is a schematic diagram of a plasma torch fired cupola and a control system for operating it.

Referring now to the drawings in detail and in particular FIG. 1, there is shown a cupola 1, which is a furnace having a base portion 3 and a vertical cylindrical housing 5 extending from the base 3. The base 3 and housing 5 are lined with fire brick 7 or other refractory material generally forming an unobstructed round open shaft 9 with an off gas conduit 10 connecting the upper end of the cupola to a stack (not shown). An opening 11 is disposed adjacent the upper end of the shaft 9 for placing a charge normally comprising coke, scrap iron or steel and a fluxing material in the cupola.

Disposed adjacent the base portion 3 is a spout portion 13 having a skimmer 15, which separates melted iron and slag which are separately drawn from the spout 13.

A plasma torch nozzle 17 is disposed in fluid communication with the lower portion of the shaft 9, while only one plasma torch nozzle is shown, it is understood that any number may be utilized. The plasma torch nozzle 17 is described in detail in an application entitled Plasma Fired Feed Nozzle filed May 8, 1987 and assigned Ser. No. 047-811.

An off gas nozzle 19 is disposed in fluid communication with the shaft 9 generally below the charge opening 11, however, its location is not critical. But it should generally be above the charge. A conduit or duct 21 extends from the off gas nozzle 19 to a cyclone separator 23 utilized to remove particulate material from the off gas. There is a blower 25 disposed in a conduit or duct 27 which provides fluid communication between the cyclone separator 23 and the plasma torch feed nozzle 17.

A plasma torch 29 is disposed in the end of a plasma torch feed nozzle 17 opposite the end opening into the cupola 1. Two particulate material bins 31 are disposed above the plasma torch nozzle 17, each bin 31 has a screw auger 33 which feeds particulate material from the respective bin at a control rate to a conduit 35 which directs the particulate material to the plasma torch feed nozzle 17.

A blast air conduit or duct 36 is disposed in fluid communication with the plasma torch nozzle and supplies combustion air for the coke.

As shown in FIG. 1, a controller 51 is utilized to control the operation start-up and shutdown of the cupola either automatically or manually. The controller 51 receives a signal from an optical pyrometer 53 or other temperature sensing means indicative of the temperature of the molten metal in the spout 13. The temperature signal received from the pyrometer 53 is compared with a predetermined temperature selected for the type of iron being produced and the use being made thereof.

A desired melt rate is entered into the controller to establish a range of plasma torch air flow, arc current and field current for the plasma torch, which will produce a heat output in a range that will result in a desired melt rate. To determine the plasma torch heat output range, things such as the charge makeup, particulate feed, amount of blast air and amount of recirculated gases are also taken into account.

A power supply 55 supplies and regulates the arc current and field current of the plasma torch and sends and receives signals related thereto to and from the controller 51. Upon receiving a signal from the controller 51 to raise or lower the output of the plasma torch, which raise or lower the temperature of the molten iron in the spout, the power supply first changes the arc current within predetermined limits. If additional changes are called for, the controller 51 then changes the air flow to the torch by operating a control valve 57 disposed in a conduit 58, which supplies air to the plasma torch. If these changes do not bring the temperature in line with the predetermined temperature, further changes are necessary. The controller 51 will then send a signal to the power supply 55 to change the field current, which sets a new range of arc current and air flow. The new range may overlap the previous range. The new arc current and air flow ranges cooperate to establish a new range of heat output for the plasma torch to further control the temperature of the molten iron in the spout. The controller 51 also controls the quantity of blast air being fed through the plasma feed nozzle 17 by operating a control valve 59 disposed in a blast air conduit 60 supplying blast or shroud air to the plasma feed nozzle 17. Recirculating gases are also fed as shroud gases via a control valve 61 disposed in the conduit 27. A cooling water sensor or control relay CR-2 is disposed in a cooling water conduit 64 which supplies cooling water to a cooling water jacket surrounding the plasma torch feed nozzle 17 and a cooling water sensor or control relay CR-3 is disposed in a cooling water conduit 66 which supplies cooling water to the plasma torch 29. The cooling water senors 63 and 65 provide signals to the controller 51 to indicate that the cooling water is flowing at a sufficient rate to protect the plasma torch and plasma torch feed nozzle. A nitrogen feed control valve 67 is disposed in a nitrogen supply conduit 69 and the controller 51 automatically operates the nitrogen control valve 67 to bleed nitrogen through the plasma torch 29 when the air supply via the conduit 58 is shut off.

Figure 2:
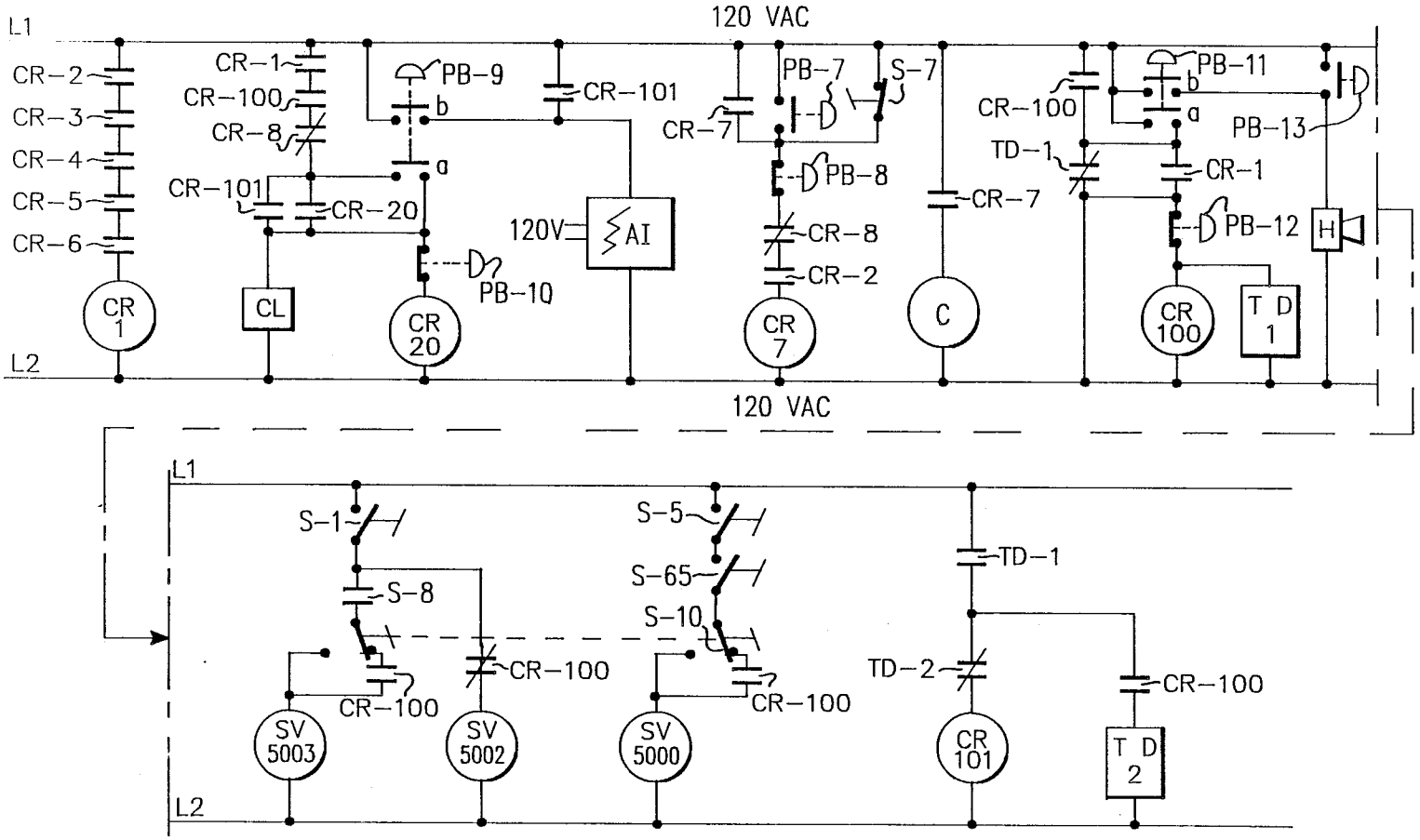
FIG. 2 is a wiring diagram showing the interlocks for automatically starting the cupola.

The control of blast air flow rate and or cycle gas flow rate, plasma torch air flow rate, torch field current is done through the controller. FIG. 2 shows a portion of the relay logic of the controller and consists of four sections, power torch, arc ignitor and start control; field power control; torch and shroud air control; and torch power and ignitor automatic start and reset. The relay logic for the torch power supply and arc ignitor start control comprises a plurality of relays and contacts disposed between electrical lines L1 and L2 which represent 120 volt AC source. The circuit includes a control relay CR-1 connected in series with the normally open contacts CR-2 which are closed by the control relay CR-2 (not shown) when there is cooling water flow to the plasma torch feed nozzle, normally open contacts CR-3 which are closed by the control relay CR-3 (not shown) when there is cooling water supplied to the plasma torch and field; normally open contacts CR-4 which are controlled by the control relay CR-4 (not shown) when the power supply permissive relays are energized, normally open contacts CR-5, which are closed by the control relays CR-5 (not shown) when air is flowing to the plasma torch and normally open contacts CR-6 which are controlled by the control relay CR-6 (not shown) when the field is energized and the lines L1 and L2.

Control relay CR-20 is included in this portion of the circuit and is connected across lines L1 and L2 in series with the normally closed pushbutton switch PB-10 which is operated to interrupt the circuit. A clock CL is connected in parallel with the pushbutton switch PB-10 and control relay CR-20. Normally open contacts CR-101 and CR-20 and the normally open a contacts of pushbutton switch PB-9 are connected and normally open contacts CR-100 of the torch and shroud air permissive control relay and normally open contacts CR-1 of the torch power permissive relay CR-1.

An arc ignitor high voltage power supply which initiates or ignites the arc in the plasma torch. Relay AI is connected across the lines L1 and L2 in series with the normally open contact CR-101 which is connected in parallel with the b contacts of the torch start switch PB-9. The field power control portion of the circuit includes control relay CR-7 which is connected across the lines L1 and L2 in series with normally open contacts CR-2, normally closed contacts CR-8 of the emergency stop switch, the normally closed and normally open contacts of the field pushbutton PB-7 connected in parallel with the normally open contact of PB-7 are normally open contact CR-7 and the automatic manual switch S-7. The field contactor C is disposed in series with the normally open contacts CR-7 across the lines L1 and L2 and also form a portion of the field power control circuit.

The torch and shroud air control portion of the circuit comprises a control relay CR-100 and a time delay relay TD-1 connected in parallel and across lines L1 and L2 in series with a normally closed contacts of test abort switch PB-12, normally open contacts CR-1 and the normally open a contacts of the test start switch PB-11. Connected in series with the contacts CR-1 are the normally closed contacts TD-1 and connected in parallel with the a contacts of PB-11 are normally open contacts CR100. A warning horn H is connected in series with the normally open contacts of the tests warning horn switch PB-13 and connected to the lines L1 and L2. Connected in parallel with the contacts of PB-13 are the b contacts of the switch PB-11.

A normal torch air solenoid valve SV-5003 is connected across line L1 and L2 in series with a torch air control switch S-1 and a cupola auxiliary equipment operational interlock switch S8 and a manual automatic mode switch S-10, which when in the manual mode, connects contacts S-1 and S-8 directly to the solenoid SV-5003 and, when in the automatic mode, interposes normally open contacts CR-100 in series therewith. A standby torch solenoid valve SV-5002 is connected across the lines L1 and L2 in series with the normally closed contacts CR-100 and the normally open contacts of the torch air control switch S-1. A solenoid for the shroud air control valve S5000 is connected across lines L1 and L2 in series with a normally open contacts of the shroud air control switch S-5 and the cupola operator blast permissive switch S-65 and the manual automatic switch S-10. When S-10 is in the manual mode, S-5 and S-65 are directly connected in series with SV5000 and when in the automatic mode normally open contacts CR-100 are interposed therebetween. The torch power and arc ignitor automatic start and reset segment of the circuit comprises a control relay CR-101 connected in series with a normally closed contacts TD-2 and normally open contact TD-1 across lines L1 and L2. Connected in parallel with the contacts TD-2 and the control relay CR-101 is a time delay TD-2 and normally open contacts CR-100.

The operation of the control system is as follows: The torch power and arc ignitor start control section consists of a pushbutton control station PB-9 and relay CR-20 with contacts to latch the relay CR-20. After torch air (CR-5) and cooling water flow (CR-2 and CR-3) are established and power alarm interlocks CR-4 are satisfied and field current CR-6 is on, the power supply permissive interlock CR-1 will close and provide power to the control pushbutton PB-9. Depressing the pushbutton switch PB-9 in manual mode will energize control relay CR-20 and latch contact associated therewith will seal in the relay. Simultaneously the torch power supply gating circuits will be activated, the arc ignitor and the plasma process elapsed time clock CL will be energized. In the automatic mode, the torch power and ignitor start control contact of PB-9 are paralleled by contacts from the control relay CR-101 of the torch power and ignitor reset circuit.

The field power control consists of a pushbutton control station PB-7 automatic and manual selector switch S-7, field water flow sensor CR-2 and associated relays. When field water flow has been established and is greater than the low set point setting of the flow switch, the contacts of switch CR-2 will close. Energizing interlocking relay CR-2 (not shown) provides a permissive circuit to the field control station. With the automatic-manual switch in the manual position, the field on pushbutton PB-7 can be depressed energizing the control relay CR-7, and closing the field supply contacts CR-7 and latching the control relay CR-7. A permissive contact CR-2 is provided to the torch power supply alarm circuit to prevent operation of the plasma torch if sufficient cooling water is not available or to deenergize the torch power supply if cooling water is lost. In normal operation field current switch S-7 will be preset in this manual mode. When set in the automatic mode, if sufficient field coil cooling water has been established, the interlock relay CR-2 will be closed to energize the field control relay CR-7. The preset field current will be established. Increase or decrease of this field current is remotely controlled during normal operation without interruption of the process.

The torch and shroud air control system is as follows: Assume that the air system is operational and that the air blast permissive switch S-65 has been closed to permit injection of air into the process reactor. Setting the operational mode switch S-10 to the manual position will permit presetting of the torch air flow at the standby and normal air flow conditions. Setting the operational mode switch S10 to automatic position will deenergize the shroud air and normal torch air solenoid valves SV-5000 and SV-5003 and energize the standby torch air solenoid valve SV-5002. Depressing the tests start pushbutton PB-11 will energize the torch and shroud air control relay CR-100, latch relay CR-100, energize the shroud air and torch normal air solenoid valves SV-5000 and SV-5003 and deenergize the torch standby air solenoid valve SV-5002. Depressing the test start button PB-11 will also sound an audible warning horn indicating eminent energization of the plasma torch providing approximately a 35 second warning for personnel in the area of the cupola and energize the time delay device TD-1. The time delay also provides sufficient time for the torch and shroud air to stabilize at the optimum starting condition of the plasma torch and process system. At the completion of the timing cycle of approximately 35 seconds, the time delay relay TD-1 contacts change their state. The normally closed contact of TD-1 that parallels the permissive relay contact CR-1 will open. If a power supply is interrupted by CR-1 or if the test abort pushbutton PB-12 is depressed the torch power supply and control relay CR-100 will be deenergized. When CR-100 is deenergized simultaneously the normal torch air and shroud air flow solenoid valves SV-5003 and 5000 will also de-energize and stand by air flow solenoid valve SV-5002 will be energized. De-energizing the time delay device TD-1 resets the timing device to 0 and unlatches the auto start control relay CR-101 and the torch power supply CR-20 and arc ignitor AI and is in the proper position to resume the delay sequence when the time delay device TD-1 is energized again.

The ignitor control reset circuit is energized after the test start pushbutton PB-11 has been depressed and the time delay device TD-1 has completed the timing sequence, a normal open contact of TD-1 will close energizing control relay CR-101 and the timing device TD-2. Energizing of the control relay CR-1 will activate its contacts to energize the torch power supply control relay CR-20 and high voltage arc ignitor AI. The relay contacts of CR-101 parallel the torch start pushbutton control PB-9 providing a manual or automatic start sequence for the system. At the completion of the timing cycle approximately ½ a second, the time delay device TD-2 normally closes contact in series with the control relay CR-101 will open and de-energize the arc ignitor AI and release a latch contact on the torch start circuit. Only momentary contact closure are required for igniting the arc. The control circuits hereinbefore described advantageously allow automatic and manual start up and operation of the cupola and diverse operation thereof to control the melting of scrap to make various grades of iron of different melt rates.

What is claimed is:

1. A method of controlling a plasma torch disposed in a feed nozzle, the plasma torch having an air supply, arc current supply, and a field current supply, which cooperate to raise and lower the heat output of the plasma torch to make molten iron from scrap metal, at a desired melt rate the molten iron being removed from the cupola at a predetermined temperature selected for the type of iron being produced via a spout disposed in the lower end of the cupola; the method comprising the steps of:

measuring the temperature of the molten iron in the spout;

comparing the measured temperature of the molten iron in the spout with the predetermined temperature selected for the type of iron being produced;

setting air flow, arc current and field current to the plasma torch in a range which will provide the heat input required to produce the desired melt rate;

individually changing the arc current, air flow and field current being supplied to the torch to change the heat output of the plasma torch, until the measured temperature of the molten iron in the spout equals the predetermined temperature.

2. The method as set forth in claim 1, wherein the step of individually changing the arc current, air flow, and field current includes first changing the arc current within predetermined limits, second changing the air flow within predetermined limits to provide a predetermined range of plasma torch heat outputs and then changing the field current to establish different predetermined limits of arc current and air flow and a different predetermined range of heat outputs for the plasma torch.

3. The method as set forth in claim 1 and further comprising the step of providing automatic start-up of the plasma torch.

4. The method as set forth in claim 1 and further comprising the step of providing automatic shutdown of the plasma torch.

5. The method as set forth in claim 3 wherein the step of providing automatic start-up of the plasma torch comprises establishing cooling water flow through the plasma torch and feed nozzle and a signal that indicates cooling water is flowing;

establishing air flow through the plasma torch and providing a signal that indicates air is flowing through the plasma torch;

establishing air flow through the plasma torch nozzle and a signal that indicates that air is flowing through the plasma torch nozzle;

establishing a field current in the plasma torch only if there is a signal indicating the cooling water and torch air are flowing;

providing a warning signal that the plasma torch is about to be ignited;

igniting the arc by superimposing a high voltage on the plasma torch arc current circuit to ignite the arc.

6. The method as set forth in claim 4, wherein shutting down the cupola comprises the steps of:

shutting off the arc and field current to the plasma torch;

shutting off air to the plasma torch;

supplying an inert gas to the plasma torch to replace the air supply;

shutting off air to the feed nozzle; and maintaining cooling water flow through the plasma torch and feed nozzle.

7. The method as set forth in claim 5 and further comprising the steps of establishing a flow of recirculated gases through the feed nozzle.

8. The method as set forth in claim 5 and further comprising the step of replacing the flow of air to the feed nozzle with recirculated gases.

9. The method as set forth in claim 8 and further comprising of shutting off the flow of recirculating gases to the feed nozzle.

10. The method as set forth in claim 5, wherein the superimposed high voltage is maintained for less than a second.

11. The method as set forth in claim 5 and further comprising a manual start-up which parallels the automatic start-up.

12. The method as set forth in claim 5 and further comprising the step of measuring the quantity of blast air being supplied to the feed nozzle and changing the quantity of blast air to control the temperature of the melted iron in the spout.

* * * * *